US007517059B2

(12) United States Patent
Hayakawa

(10) Patent No.: US 7,517,059 B2
(45) Date of Patent: Apr. 14, 2009

(54) LIQUID JET HEAD AND METHOD FOR PRODUCING THE SAME

(75) Inventor: Kazuhiro Hayakawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 11/279,633

(22) Filed: Apr. 13, 2006

(65) Prior Publication Data

US 2006/0256162 A1 Nov. 16, 2006

(30) Foreign Application Priority Data

May 10, 2005 (JP) ..... 2005-137153

(51) Int. Cl.
*B41J 2/05* (2006.01)

(52) U.S. Cl. ..... 347/64

(58) Field of Classification Search ..... 347/64, 347/65, 44–46

See application file for complete search history.

(56) References Cited

U.S. PATENT DOCUMENTS 5,218,376 A 6/1993 Asai
5,729,261 A * 3/1998 Burke et al. ..... 347/64
7,063,799 B2 6/2006 Hayakawa et al.
2004/0238485 A1 12/2004 Hayakawa et al.
2005/0140737 A1 6/2005 Ushijima et al.
2005/0248623 A1 11/2005 Komura et al.
2006/0214995 A1 9/2006 Hayakawa et al.
2007/0058001 A1 3/2007 Hayakawa

* cited by examiner

*Primary Examiner*—Manish S Shah
*Assistant Examiner*—Geoffrey Mruk
(74) *Attorney, Agent, or Firm*—Fitzpatrick, Cella, Harper & Scinto

(57) ABSTRACT

In a liquid jet recording head, a liquid is prevented from eroding a substrate, significant deformation of a discharge port forming member caused by absorption of the liquid is prevented even in long-term use, and reliability is improved in a discharging operation of a liquid droplet. The liquid jet recording head includes a substrate in which a plurality of heaters are formed; a plurality of discharge ports which are formed corresponding to the heaters, the discharge ports discharging liquid droplets; a liquid flow path; and a supply port. The liquid flow path is communicated with each discharge port, and a heater is provided in an inner wall surface of the liquid flow path. The supply port pierces through the substrate while communicating with the liquid flow path. All the inner surfaces of the supply port and a part of the inner surface of the liquid flow path are covered with the same protective layer.

6 Claims, 7 Drawing Sheets

LIQUID JET HEAD AND METHOD FOR PRODUCING THE SAME

BACKGROUND OF THE INVENTION

1. Field of the Invention

The present invention relates to a liquid jet head which discharges a liquid droplet such as an ink droplet and a method for producing the liquid jet head, particularly to a side-shooter type recording head.

2. Related Background Art

Recently an ink jet recording method spreads rapidly on the point that noise generation in recording is extremely small to an extent that the noise can be neglected, on the point that high-speed recording can be performed, on the point that ink can be fixed onto so-called plain paper, and on the point that the recording can be performed with no particular step. Among ink jet recording heads, the ink jet recording head which discharges a liquid droplet in a perpendicular direction with respect to a substrate, in which an ink discharge energy generating element is formed, is referred to as "side-shooter type recording head."

As disclosed in U.S. Pat. No. 5,218,376, it is well known that a side-shooter type recording head has a configuration in which the ink liquid droplet is discharged by communicating a bubble, generated by heating a heating resistive element, with outside air. In the side-shooter type recording head, a distance between the ink discharge energy generating element and an orifice (discharge port) can be shortened, the small liquid droplet recording can easily be achieved, and recently required high-resolution recording can be realized.

As shown in FIG. 1, the conventional ink jet recording head frequently has the configuration in which the ink supplied from a side of a cartridge constituting member 110 is supplied onto a heater 116 in a liquid flow path 113 through a supply port 114 formed while piercing through a substrate 111. Usually a passivation layer 119 is formed on an interconnection and an integrated circuit (IC) on a surface in which the substrate 111, the heater 116, and drive circuits thereof are formed. The passivation layer 119 protects the substrate 111, the heater 116, and the drive circuits thereof from oxygen, moisture content, and other chemical damages.

However, a material constituting the substrate 111 is exposed to an inner wall surface of the supply port 114 formed in the substrate 111. Therefore, when the ink has a corrosive property because the ink is not neutral and the like, sometimes the inner wall surface of the substrate 111 is eroded by the ink in association with use of the recording head.

When the material of the substrate 111 is dissolved in the ink, physical properties of the ink, particularly surface tension and viscosity are changed, which has an adverse affect on discharge characteristics of the ink droplet. For example, when the substrate 111 is made of silicon while the ink has alkalinity, the above problem is generated.

The inner wall surface constituting the liquid flow path 113 and an orifice plate 112 in which a discharge port 117 is formed are frequently made of a resin material because the resin material is easily formed. When the orifice plate 112 is made of the resin material, sometimes the orifice plate 112 absorbs the ink to swell in association with the long-term use of the recording head. Particularly, because the orifice plate 112 has a structure in which a region which faces the supply port 114 does not relatively widely abut on the substrate 111, the deformation caused by the swelling is remarkably generated in the region. When the large deformation reaches to a neighborhood of the discharge port 117, a discharge direction of the ink droplet discharged from a nozzle is caused to become unstable, and there is a fear that the orifice plate 112 is peeled off from the substrate 111 due to stress generated by the swelling.

SUMMARY OF THE INVENTION

An object of the invention is to provide a liquid jet recording head in which the liquid is prevented from eroding the substrate, the significant deformation of the discharge port forming member caused by the absorption of the liquid is prevented even in the long-term use, and reliability is improved in the discharging operation of the liquid droplet, and a method for producing a liquid jet head.

In order to achieve the object, a liquid jet head according to the invention includes: a substrate in which a plurality of discharge energy generating elements are formed; a plurality of discharge ports which are formed corresponding to the discharge energy generating elements, respectively, the discharge ports discharging liquid droplets; a liquid flow path which is formed to communicate with each discharge port, the discharge energy generating element being provided in an inner wall surface of the liquid flow path; and a supply port which is formed by piercing through the substrate, the supply port being communicated with the liquid flow path. In the liquid jet head, an inner wall surface of the supply port and a part of the inner wall surface of the liquid flow path are covered with the same protective layer.

Thus, according to the invention, because the protective layer is formed in the inner wall surface of the supply port, even if the acid or alkaline liquid is used, the liquid is prevented from eroding the substrate, and the generation of the discharge failure of the liquid droplet can be suppressed. Further, according to the invention, the protective layer is also formed in a part of the inner wall surface of the liquid flow path. Accordingly, even if the liquid discharging head is used for a long time, the discharge port forming member deformation caused by the swelling is small, which suppresses the shift in the discharge direction of the liquid droplet or the peel-off of the discharge port forming member from the substrate. Therefore, the reliability can be improved in the discharging operation of the liquid droplet to realize high quality.

BRIEF DESCRIPTION OF THE PREFERRED EMBODIMENTS

Preferred embodiment of the invention will be described below with reference to the drawings.

First Embodiment

Figure 1:
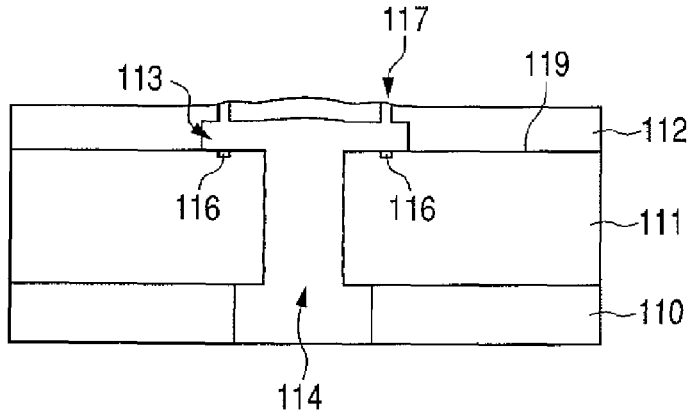
FIG. 1 is a sectional view schematically showing a conventional ink jet recording head.
Figure 2:
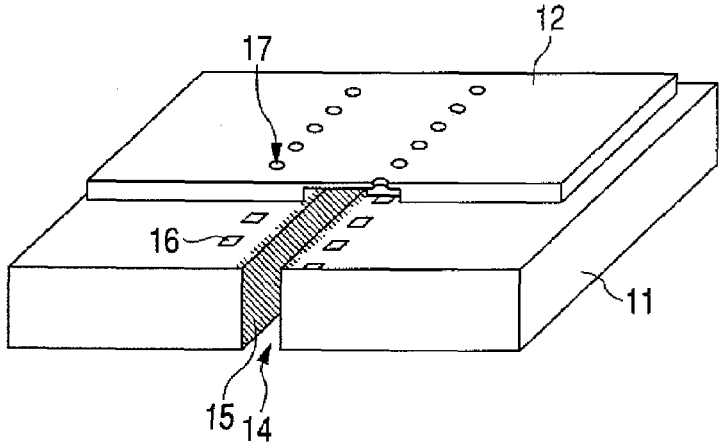
FIG. 2 is a perspective view showing an ink jet recording head according to a first embodiment of the invention.
Figure 3A:
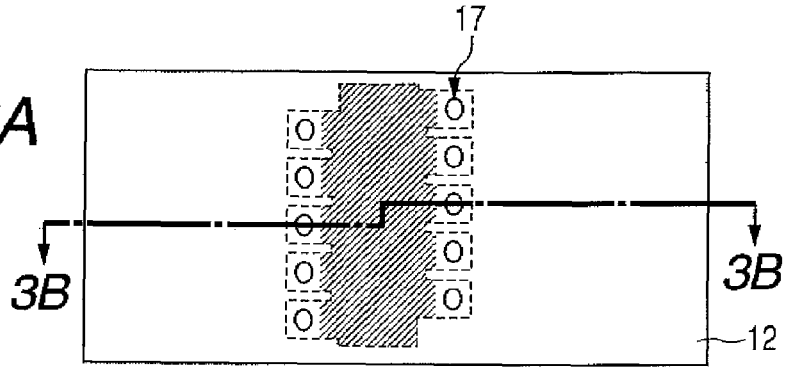
FIG. 3A is a top view of the ink jet recording head shown in FIG. 2.
Figure 3B:
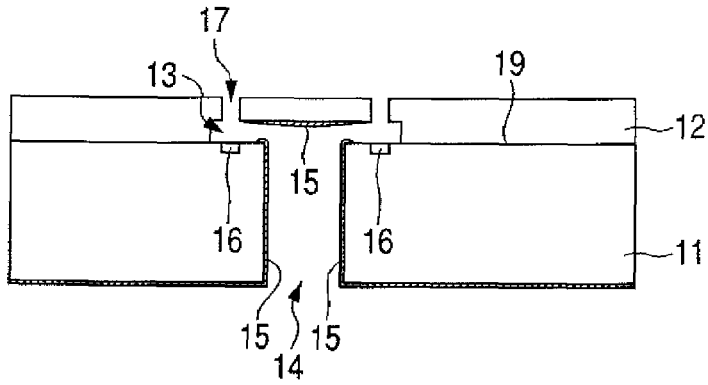
FIG. 3B is a sectional view taken on line 3B-3B of FIG. 3A.

As shown in FIGS. 2, 3A, and 3B, an ink jet recording head according to a first embodiment includes a silicon substrate 11. Plural heaters 16, which are discharge energy generating elements, are formed in the silicon substrate 11. The ink jet recording head of the first embodiment also includes an orifice plate 12 and a liquid flow path 13. In the orifice plate 12, a plurality of discharge ports 17 are formed corresponding to the heaters 16. The discharge port 17 is an orifice which discharges the ink droplet. The liquid flow path 13 is formed while communicated with each discharge port 17, and the heater 16 is provided in the inner wall surface of the liquid flow path 13. A supply port 14 is formed in the substrate 11. The supply port 14 is formed by piercing through the substrate 11, and the supply port 14 is communicated with the liquid flow path 13. All the inner wall surfaces of the supply port 14 and a part of the inner wall surface in the liquid flow path 13, which faces the supply port 14, are covered with the same protective layer 15.

For example, the protective layer 15 is made of silicon oxide, silicon nitride, SiC, SiOC, and other silicon compounds, or alumina, tantalum nitride, and other inorganic films.

The protective layer 15 can prevent the ink from coming into direct contact with the inner wall surface of the substrate 11. Therefore, while the erosion of the substrate 11 by the ink is prevented, the region where the inner wall surface of the orifice plate 12 comes into direct contact with the ink is decreased, which allows the deformation by the swelling of the orifice plate 12 to be suppressed.

The protective layer 15 is preferably formed such that the surface on the side of the discharge port 17 of the substrate 11, namely, a corner portion of an opening edge portion of the supply port 14 on the front surface side of the substrate 11 is covered with the protective layer 15. Because the corner portion of the opening edge portion of the supply port 14 on the front surface side of the substrate 11 is sufficiently covered with the protective layer 15, the reliability of the discharging operation of the ink droplet can further be improved.

The protective layer 15 is made of silicon oxide whose surface has a hydrophilic property. Therefore, when a main content of an ink solvent is water, there is obtained an effect that a bubble is difficult to reside on the surface of the protective layer 15.

The protective layer 15 may have a configuration in which the protective layer 15 is not formed on the surface of the heater 16. This is because sometimes the protective layer 15 is not formed on the pressure generating element depending on the configuration of the discharge energy generating element. For example, regarding the heater 16, which generates discharge pressure by the bubble of the ink like the first embodiment, sometimes a protective film is formed on the heater 16 such that kogation is not generated and the kogation does not adhere to the surface of the heater 16. When a metal film such as Ta is used as the protective film, it is thought that the protective film is formed by a sputtering method or the like. When a film source has directivity with respect to the substrate 11 like the sputtering method, it is necessary that the protective film for protecting the heater 16 be deposited before the orifice plate 12 is provided on the heater 16 formed in the substrate 11. At this point, it is thought that the formation of another protective film is avoided on the protective film already formed on the heater 16.

It is also thought that the protective layer 15 is not formed in the inner wall surface of the discharge port 17. Because the material which is of the film source for forming the protective layer 15 is introduced from the supply port 14, a film thickness tends to be increased in a portion near the supply port 14 rather than a portion far away from the supply port 14. Therefore, the protective film is unevenly formed on the inner wall surface of the discharge port (nozzle) 17, which results in a fear that a nozzle shape of the discharge port 17 is changed. This is the reason why the protective layer 15 is not formed in the inner wall surface of the discharge port 17.

A passivation layer 19 is formed on the interconnection and the integrated circuit (IC) on the surface in which the substrate 11, the heater 16, and drive circuits thereof are formed. The passivation layer 19 protects the substrate 11, the heater 16, and the drive circuits thereof from oxygen, moisture content, and other chemical damages.

Then, a method for producing the ink jet recording head will be described with reference to FIG. 4.

The method for producing a liquid jet head of the first embodiment has the following six steps.

Figure 4A:
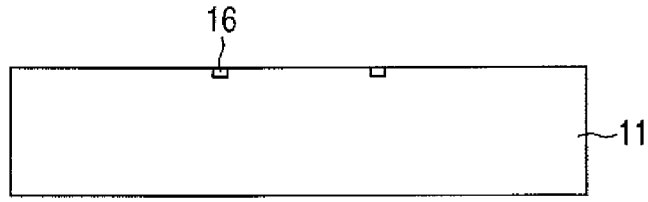
FIGS. 4A, 4B, 4C, 4D, 4E and 4F are sectional views schematically showing a step of producing the ink jet recording head of the first embodiment of the invention.
Figure 4B:
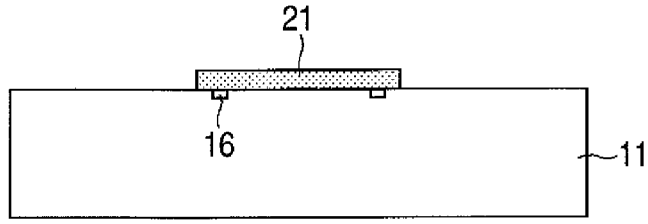
Figure 4C:
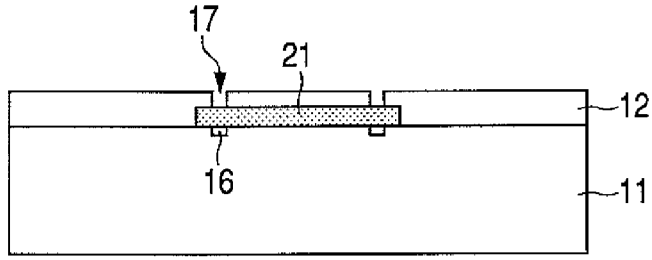
Figure 4D:
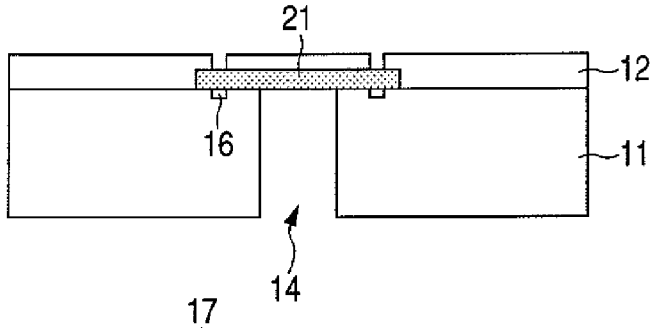
Figure 4E:
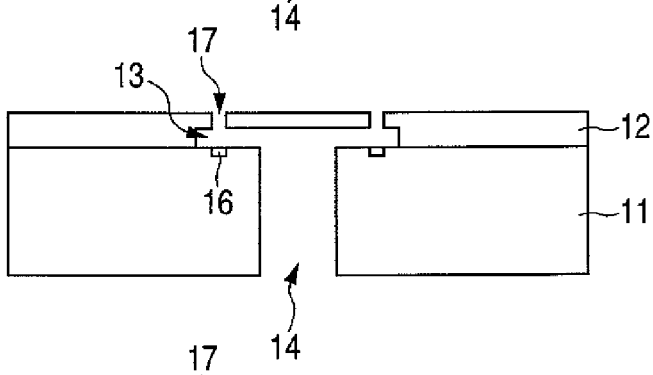
Figure 4F:
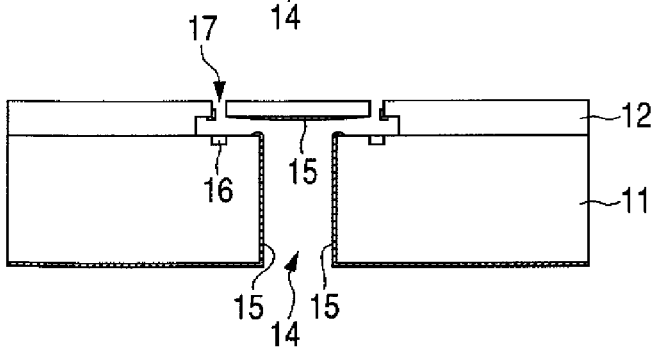

As shown in FIG. 4A, a first step is a step of preparing the substrate 11 in which the heater 16 is provided. As shown in FIG. 4B, a second step is a step of forming a flow path mold 21 on the surface of the substrate 11 in which the heater 16 is formed. The flow path mold 21 can selectively be removed. As shown in FIG. 4C, in a third step, the orifice plate 12 and a flow path wall are formed such that the flow path mold 21 is covered with the orifice plate 12 and the flow path wall, and the discharge port 17 which discharges the ink droplet is formed in the orifice plate 12. As shown in FIG. 4D, a fourth step is a step of forming the supply port 14 while the supply port 14 pierces through the substrate 11. As shown in FIG. 4E, a fifth step is a step of removing a part of the flow path mold 21 from the side of the supply port 14. The part of the flow path mold 21 corresponds to at least the region where the protective layer 15 is formed. As shown in FIG. 4F, in a sixth step, the film source is introduced from the supply port 14, and the protective layer 15 is deposited in a range from the inner wall surface of the supply port 14 to the inner wall surface of the orifice plate 12. Each step will be described in detail below.

In the first step, as shown in FIG. 4A, the heater 16 and a drive circuit (not shown) thereof are formed on the silicon substrate 11 through a general-purpose semiconductor step. At this point, in the substrate 11, the surface in which the heater 16 is formed is set at the front surface, and the opposite surface to the front surface is set at the backside.

In the second step, solvent coating of polymethyl isopropenyl ketone is performed onto the substrate 11. The polymethyl isopropenyl ketone is a UV (ultraviolet) resist which can be removed in a dissolved manner in a post-process. The UV resist is exposed with UV light, and the UV resist is developed to form the flow path mold 21 as shown in FIG. 4B.

In the third step, a cationic polymerization type epoxy resin which is of a negative-type resist is applied onto the surface of the substrate 11 in which the flow path mold 21 is formed, and the flow path wall which partitions a ceiling of the liquid flow path 13 of the ink and each liquid flow path 13 is formed. The exposure and the development are performed to the negative-type resist using a photomask having a predetermined pattern, and the negative-type resist located in the discharge port 17 and an electrode pad (not shown) is removed to form the orifice plate 12 as shown in FIG. 4C.

In the fourth step, the resist is applied to both the front surface and the backside of the substrate 11, and a predetermined pattern having an opening corresponding to a position where the supply port 14 is formed is formed by a photolithographic technique. Dry etching is performed while the resist is used as a mask, and the supply port 14 which is of a through hole is formed in the substrate 11 while piercing through the substrate 11 as shown in FIG. 4D. At this point, for example, an ICP (Inductive Coupling Plasma)-RIE (Reactive Ion Etching) etching apparatus is used for the dry etching.

Then, in the fifth step, after the resists on both the front surface and the backside of the substrate 11 are removed using a stripping solution, the flow path mold 21 is exposed through the orifice plate 12. As shown in FIG. 4E, the flow path mold 21 is removed by immersing the whole of the substrate 11 into methyl lactate. At this point, ultrasound may be imparted if needed. The flow path mold 21 is formed by a positive-type resist.

In the sixth step, the film source is introduced from the backside of the substrate 11 into the supply port 14. Therefore, as shown in FIG. 4F, the protective film which forms the protective layer 15 is deposited in at least all the inner wall surfaces of the supply port 14 and a part of the inner wall surface of the orifice plate 12. At this point, while the surface of the substrate 11 is shielded if needed, the protective film is deposited. The deposition methods by physical action or chemical action including a plasma CVD (Chemical Vapor Deposition) method, a catalyst CVD method, an evaporation method, and the sputtering method can be cited as an example of the method for depositing the protective layer 15. The silicon compound such as SiN, SiO, SiC, and SiOC and the inorganic film such as alumina and tantalum nitride can be cited as an example of the protective film. Then, the substrate 11 is cut by dicing to obtain the ink jet recording head of the first embodiment.

Second Embodiment

In the method for producing a ink jet recording head of the first embodiment, the protective layer 15 adhering to the flow path mold 21 is destroyed and removed at the same time when the flow path mold 21 is removed. However, when the protective layer 15 is relatively thickened, the removal of the protective layer 15 becomes difficult.

Therefore, in a method for producing a ink jet recording head according to a second embodiment, although the steps of the first step to the fourth step are similar to those of the method for producing a liquid jet head of the first embodiment, the steps from the fifth step are changed as follows.

Figure 5A:
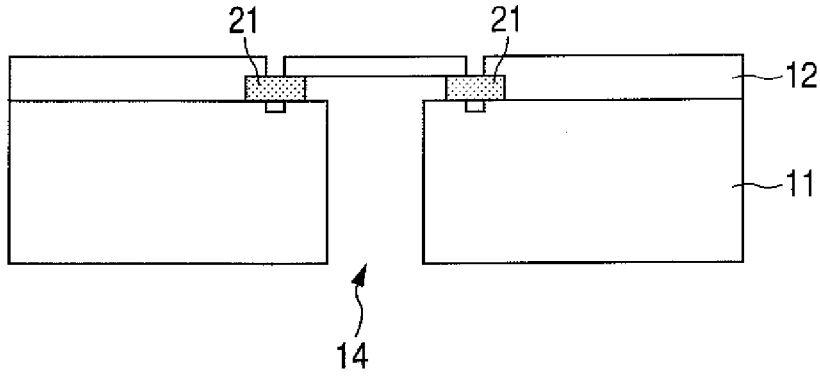
FIGS. 5A, 5B and 5C are sectional views schematically showing a main part of a step of producing an ink jet recording head according to a second embodiment of the invention.
Figure 5B:
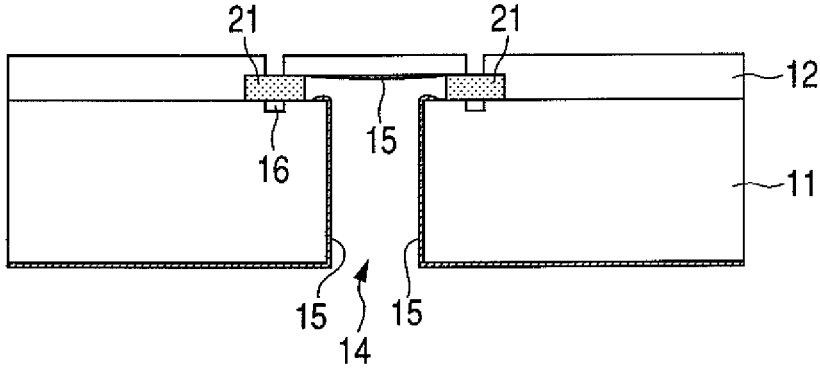
Figure 5C:
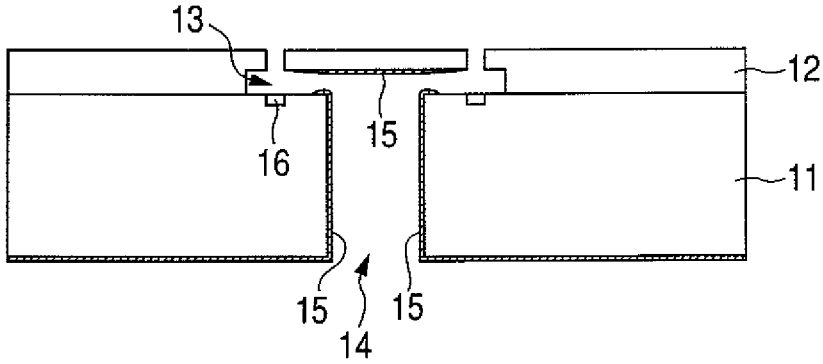
Figure 6A:
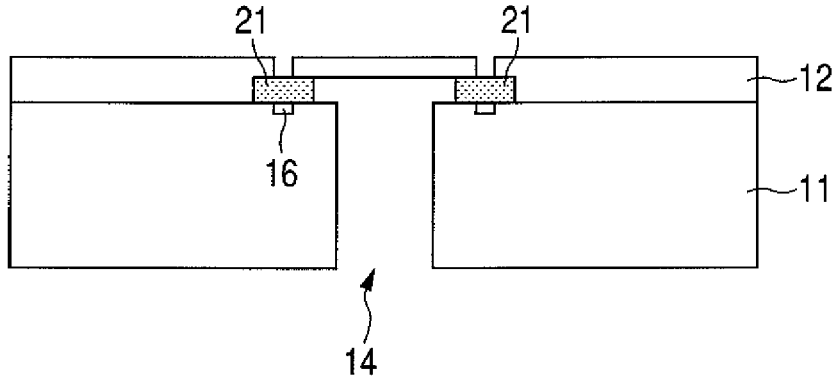
FIGS. 6A, 6B, 6C and 6D are sectional views schematically showing a main part of a step of producing an ink jet recording head according to a third embodiment of the invention.
Figure 6B:
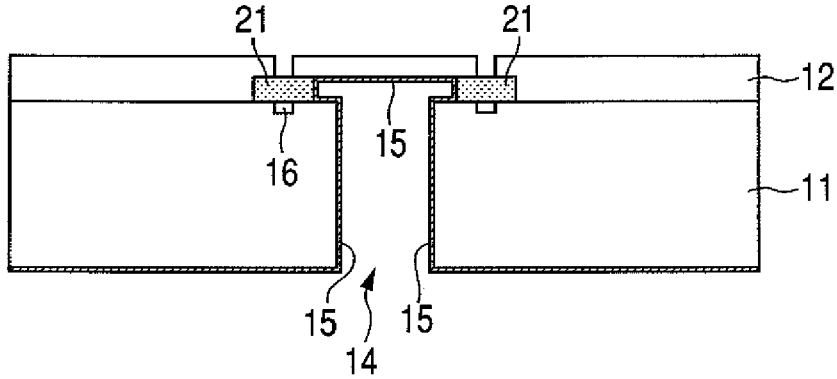
Figure 6C:
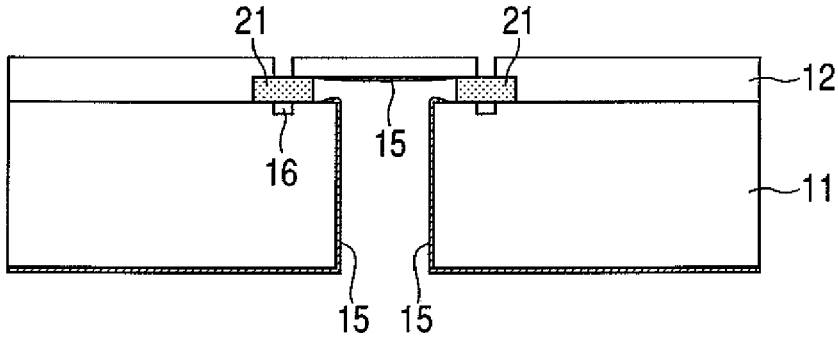
Figure 6D:
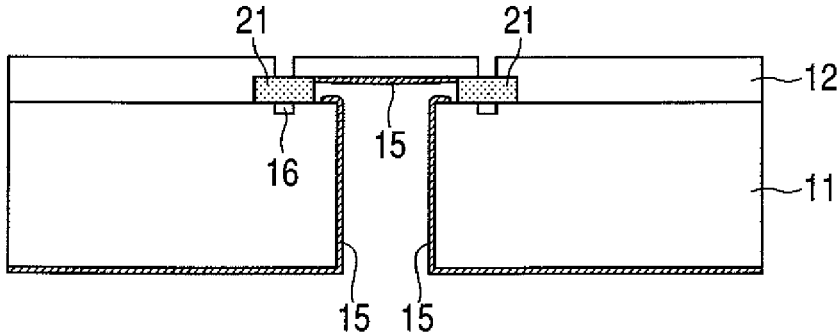

As shown in FIG. 5A, the fifth step is a step of removing a part of the flow path mold 21 from the side of the supply port 14. The part of the flow path mold 21 corresponds to the region where the protective layer 15 is formed. As shown in FIG. 5B, in the sixth step, the film source is introduced from the supply port 14, and the protective layer 15 is deposited in the range from the inner wall surface of the supply port 14 to the inner wall surface of the orifice plate 12. As shown in FIG. 5C, the seventh step is a step of removing the remainders of the flow path mold 21 along with the protective film adhering to the flow path mold 21.

In the fifth step, after the resists on both the front surface and the backside of the substrate 11 are removed with the stripping solution, a part of the flow path mold 21 is exposed through the orifice plate 12. The part of the flow path mold 21 corresponds to the region of the liquid flow path 13 where the protective film is deposited. As shown in FIG. 5A, the exposed flow path mold 21 is developed and removed from the supply port 14 by immersing the flow path mold 21 in xylene. At this point, the ultrasound may be imparted if needed.

In the sixth step, while the surface of the substrate 11 is shielded if needed, the film source is introduced from the backside of the substrate 11 into the supply port 14. Therefore, as shown in FIG. 5B, the protective film which forms the protective layer 15 is deposited in at least all the inner wall surfaces of the supply port 14 and a part of the inner wall surface of the orifice plate 12.

Then, all the flow path molds 21 are exposed through the orifice plate 12. In the seventh step, as shown in FIG. 5C, the substrate 11 is immersed in methyl lactate while the ultrasound is imparted, and the flow path mold 21 and the protective film adhering to the flow path mold 21 are removed. The substrate 11 is cut by the dicing to obtain the ink jet recording head of the second embodiment.

Third Embodiment

Because the steps in a third embodiment, in which the film source is introduced from the backside of the substrate 11 to deposit the protective layer 15 on at least all the inner wall surfaces of the supply port 14 after the supply port 14 is formed in the substrate 11, are similar to the first embodiment, the descriptions of the steps will be omitted.

After the protective layer 15 is deposited, the flow path mold 21 is exposed through the orifice plate 12. The flow path mold 21 corresponds to the region of the liquid flow path 13 where the protective film is deposited again.

The substrate 11 is immersed in the development solution while the ultrasound is imparted, the exposed flow path mold 21 and the protective film adhering to the flow path mold 21 are removed from the supply port 14.

As shown in FIGS. 6A to 6D, if needed, the step of depositing the protective layer 15 and the step of removing the flow path mold 21 are repeated to perform the depositions of the protective film on the inner wall surface of the supply port 14 and the inner wall surface of the liquid flow path 13.

After the protective film having the desired film thickness is formed, all the flow path molds 21 are exposed, and the flow path molds 21 are removed by immersing the substrate 11 in methyl lactate or the development solution. Then, the substrate 11 is cut by the dicing to obtain the ink jet recording head of the third embodiment.

The film thickness of the protective film formed in the inner wall surface of the supply port 14 can be increased through the steps of the third embodiment. Even if irregularities are generated in the inner wall surface of the supply port 14, the irregularities can sufficiently be covered to obtain the smooth inner peripheral surface. Even if particles adhere to the inner wall surface in forming the supply port 14, the particles are covered with the protective film, which allows the particles to be prevented from flowing out in the ink to become dust.

Fourth Embodiment

Figure 7A:
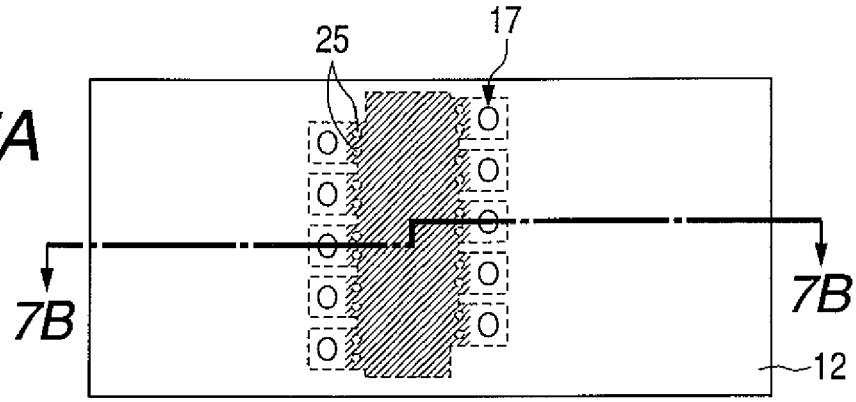
FIGS. 7A and 7B show ink jet recording heads according to a fourth embodiment of the invention.
Figure 7B:
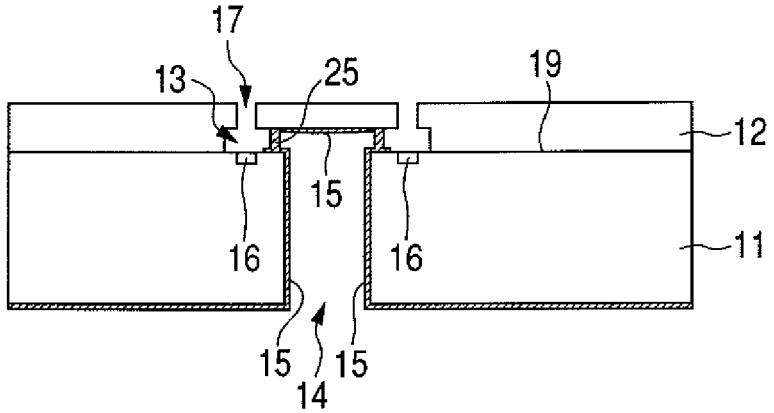

As shown in FIGS. 7A and 7B, an ink jet recording head according to a fourth embodiment has the configuration in which a nozzle filter 25 for filtering dust in the ink is arranged in the liquid flow path 13. Thus, the protective film is also formed in the nozzle filter 25, which allows the swelling of the nozzle filter 25 due to the ink to be suppressed similarly to the orifice plate 12. Therefore, lack of ink refill can be prevented. The lack of the ink refill is generated because the nozzle filter 25 swells to narrow the liquid flow path 13 in association with the use of the recording head.

Fifth Embodiment

Figure 8A:
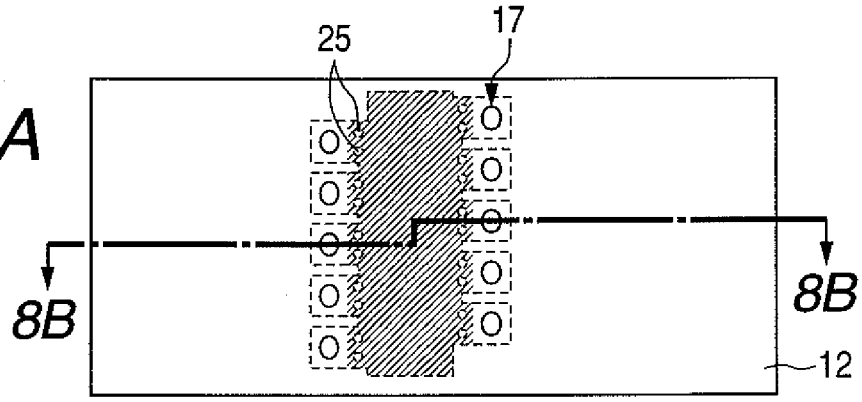
FIGS. 8A and 8B show ink jet recording heads according to a fifth embodiment of the invention.
Figure 8B:
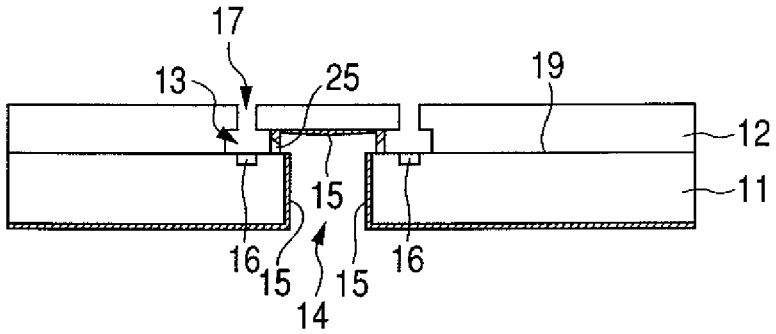
Figure 9A:
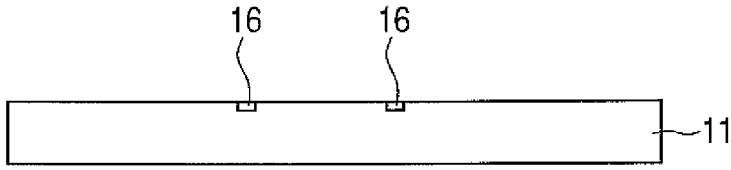
FIGS. 9A, 9B, 9C, 9D, 9E and 9F are sectional views schematically showing a step of producing the ink jet recording head of the fifth embodiment of the invention.
Figure 9B:
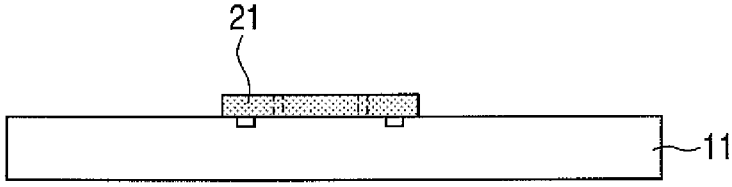
Figure 9C:
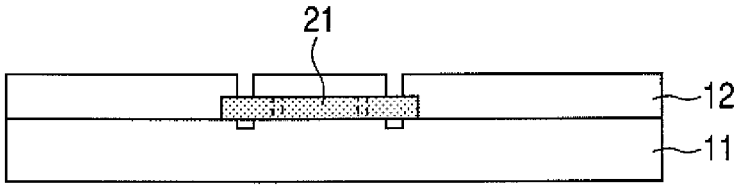
Figure 9D:
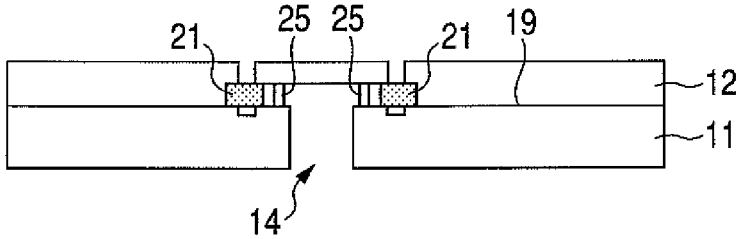
Figure 9E:
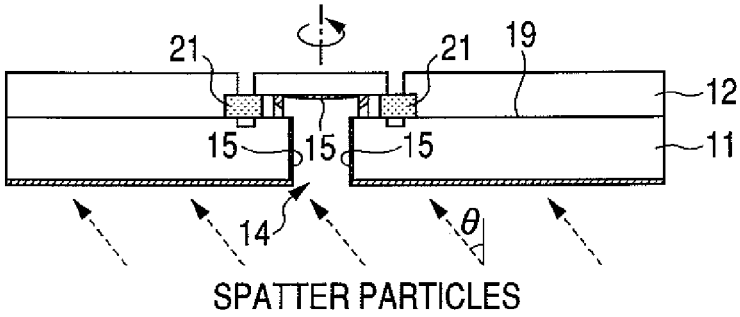
Figure 9F:
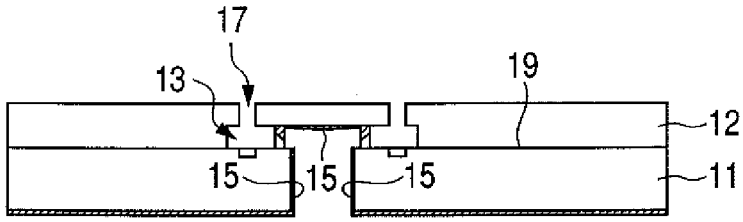

As shown in FIGS. 8A and 8B, similarly to the fourth embodiment shown in FIGS. 7A and 7B, an ink jet recording head according to a fifth embodiment has the configuration in which the nozzle filter 25 for filtering dust in the ink is arranged in the liquid flow path 13. Thus, the protective film is formed in the nozzle filter 25, which allows the swelling of the nozzle filter 25 due to the ink to be suppressed similarly to the orifice plate 12.

In the fifth embodiment, as shown in FIGS. 9A to 9F, the protective film is deposited by a method such as the sputtering method in which the film source is caused to fly onto the substrate 11 with the directivity to deposit the film source on the substrate 11. In the fifth embodiment, an opening aperture and an opening size of the supply port 14 and the thickness of the substrate 11 are appropriately set such that the protective film is formed on the whole of the inner wall surface of the supply port 14 and a part of the inner peripheral wall of the orifice plate 12.

Sixth Embodiment

Figure 10A:
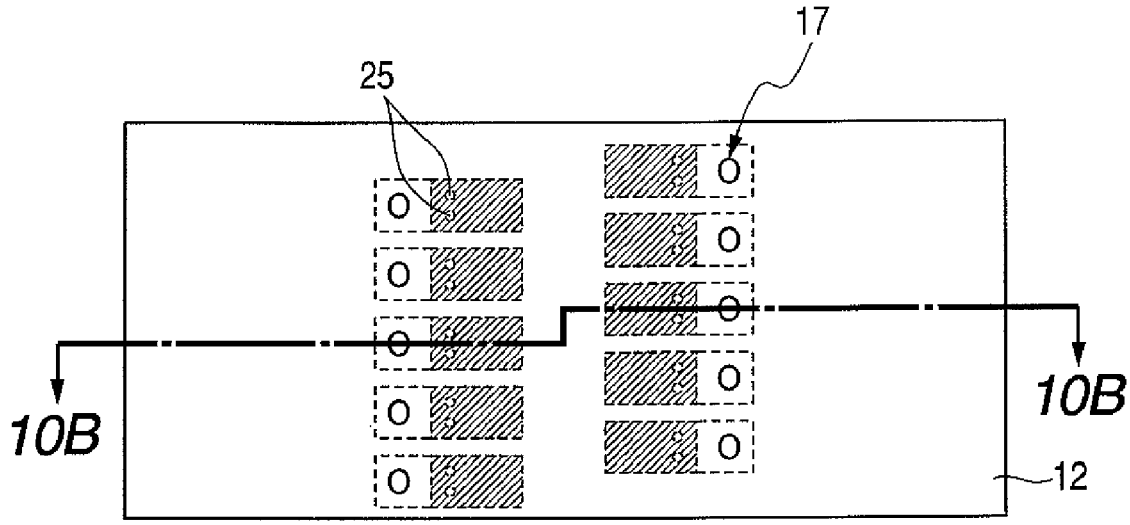
FIGS. 10A and 10B show ink jet recording heads according to a sixth embodiment of the invention.
Figure 10B:
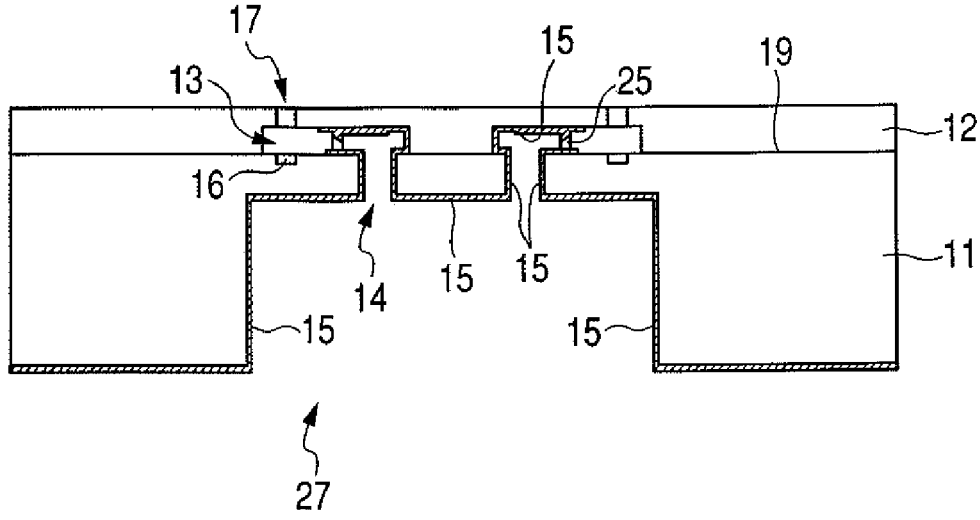

As shown in FIGS. 10A and 10B, in the structure of an ink jet recording head according to a sixth embodiment, a common liquid chamber 27 is provided in the substrate 11, the supply port 14 is formed while communicated with the common liquid chamber 27, and the ink is supplied from the common liquid chamber 27 to the liquid flow path 13 through the supply port 14. The structure of the sixth embodiment enables mechanical strength of the substrate 11 to be enhanced. Particularly the corner portion formed by the coupled portion between the common liquid chamber 27 and the supply port 14 is easy to be eroded by the ink. However, the erosion of the ink can be suppressed to improve the reliability of the discharging operation of the ink droplet by forming the protective film with which the corner portion is covered.

This application claims priority from Japanese Patent Application No. 2005-137153 filed May 10, 2005, which is hereby incorporated by reference herein.

What is claimed is:

1. A liquid jet head comprising:

a substrate in which a discharge energy generating element is provided on one surface;

a discharge port forming member which is provided with a discharge port corresponding to the discharge energy generating element, the discharge port discharging a liquid droplet, the discharge ort forming member being provided on the substrate;

a liquid flow path which is formed to be communicated with the discharge port; and a supply port which is formed by piercing through the one surface of the substrate to a back surface of the substrate, the supply port communicating with the liquid flow path, wherein an inner wall surface of the supply port and a part of a surface of an inner wall, formed by the discharge port forming member, of the liquid flow path are covered with a protective layer made of the same material.

2. A liquid jet head according to claim 1, wherein the protective layer is made of a silicon compound or an inorganic film.

3. A liquid jet head according to claim 2, wherein the protective layer is made of any one of silicon oxide, silicon nitride, SiC, SiOC, alumina, and tantalum nitride.

4. A liquid jet head according to claim 1, wherein a portion of the protective layer, covering the inner wall surface of the supply port, is not continuous from a portion covering the liquid flow path formed by a surface of an inner wall and the discharge port forming member.

5. A liquid jet head comprising:

a silicon substrate in which a discharge energy generating element is provided on one surface;

a discharge port forming member, which is made from resin and provided with a discharge port corresponding to the discharge energy generating element, the discharge port discharging a liquid droplet, the discharge port forming member being provided on the substrate;

a liquid flow path which is formed to communicate with the discharge port; and a supply port which is formed by piercing through the one surface of the substrate to a back surface of the substrate, the supply port communicating with the liquid flow path, wherein an inner wall surface, made of silicon, of the supply port, and a part of a surface of an inner wall of the liquid flow path, formed by the discharge port forming member, are covered with a protective layer made of the same material.

6. A liquid jet head comprising:

a silicon substrate in which a discharge energy generating element is provided on one surface;

a discharge port forming member which is provided with a discharge port corresponding to the discharge energy generating element, the discharge port discharging a liquid droplet, the discharge port forming member being provided on the substrate;

a liquid flow path which is formed to communicate with the discharge port;

a supply port which is formed by piercing through the one surface of the substrate to a back surface of the substrate, the supply port communicating with the liquid flow path; and a filter member provided in the liquid flow path between the supply port and the discharge port, wherein an inner wall surface, made of silicon, of the supply port, a part of a surface of an inner wall, formed by the discharge port forming member, of the liquid flow path, and the filter member are covered with the same protective layer.

* * * * *